US009157590B2

(12) United States Patent
Burkard et al.

(10) Patent No.: US 9,157,590 B2
(45) Date of Patent: Oct. 13, 2015

(54) BASE CARRIER, LIGHT SOURCE CARRIER AND SYSTEM COMPRISING A BASE CARRIER AND A LIGHT SOURCE CARRIER

(75) Inventors: Klaus Burkard, Regensburg (DE); Christian Hacker, Regensburg (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/581,456

(22) PCT Filed: Feb. 4, 2011

(86) PCT No.: PCT/EP2011/051658

§ 371 (c)(1),
(2), (4) Date: Aug. 27, 2012

(87) PCT Pub. No.: WO2011/104102

PCT Pub. Date: Sep. 1, 2011

(65) Prior Publication Data

US 2012/0320584 A1 Dec. 20, 2012

(30) Foreign Application Priority Data

Feb. 26, 2010 (DE) ..... 10 2010 002 389

(51) Int. Cl.

| | |
|---|---|
| ***F21V 21/00*** | (2006.01) |
| ***F21S 8/08*** | (2006.01) |
| ***F21V 19/00*** | (2006.01) |
| ***F21V 23/06*** | (2006.01) |
| *F21K 99/00* | (2010.01) |
| *F21W 131/103* | (2006.01) |
| *F21Y 101/02* | (2006.01) |

(52) U.S. Cl.

CPC ..... *F21S 8/088* (2013.01); *F21V 19/001* (2013.01); *F21V 23/06* (2013.01); *F21K 9/00* (2013.01); *F21W 2131/103* (2013.01); *F21Y 2101/02* (2013.01)

(58) Field of Classification Search

CPC ..... F21V 23/06; F21V 23/005; F21V 23/026; F21V 19/001; F21V 9/00

USPC ..... 362/249.02, 249.04, 249.08, 255, 431, 362/646, 652, 657, 658, 659

See application file for complete search history.

(56) References Cited

U.S. PATENT DOCUMENTS

| | | | | |
|---|---|---|---|---|
| 3,514,590 | A * | 5/1970 | Shaeffer | 362/221 |
| 4,504,891 | A * | 3/1985 | Mazis | 362/221 |
| 6,461,008 | B1 * | 10/2002 | Pederson | 362/249.02 |
| 6,565,231 | B1 * | 5/2003 | Cok | 362/652 |
| 7,549,786 | B2 * | 6/2009 | Higley et al. | 362/646 |
| 7,585,090 | B2 * | 9/2009 | Wu | 362/646 |
| 8,113,684 | B2 * | 2/2012 | Quercia et al. | 362/220 |
| 8,337,214 | B2 * | 12/2012 | Sheek | 439/56 |
| 2005/0254264 | A1 | 11/2005 | Sidwell et al. | |
| 2009/0011618 | A1 | 1/2009 | Stoyan | |

FOREIGN PATENT DOCUMENTS

| | | |
|---|---|---|
| DE | 102 12 895 | 10/2003 |
| DE | 203 00 806 | 7/2004 |

(Continued)

*Primary Examiner* — Y M Lee
(74) *Attorney, Agent, or Firm* — Cozen O'Connor

(57) ABSTRACT

A base carrier (2) for an illumination device (L1; L2; L3), comprising a printed circuit board (4) having at least one first plug-in connection element (9) for mechanically securing and electrically coupling a light source carrier (3) to the printed circuit board (4).

16 Claims, 6 Drawing Sheets

(56) References Cited

FOREIGN PATENT DOCUMENTS

| | | |
|---|---|---|
| DE | 10 2007 024 422 | 11/2008 |
| DE | 10 2007 028 463 | 1/2009 |
| EP | 1 659 337 | 5/2006 |
| KR | 100 875 724 | 12/2008 |
| WO | WO 2010/002156 | 1/2010 |
| WO | WO 2010/040645 | 4/2010 |

* cited by examiner

BASE CARRIER, LIGHT SOURCE CARRIER AND SYSTEM COMPRISING A BASE CARRIER AND A LIGHT SOURCE CARRIER

RELATED APPLICATIONS

This is a U.S. National Phase Application under 35 USC 371 of International Application PCT/EP2011/051658 filed on Feb. 4, 2011.

This application claims the priority of German Application No. 10 2010 002 389.2 filed Feb. 26, 2010, the content of which is hereby incorporated by reference.

FIELD OF THE INVENTION

The invention relates to a printed circuit board for an illumination device, a light source carrier having at least one light source, and a system consisting of a printed circuit board and at least one light source carrier.

BACKGROUND OF THE INVENTION

For variable alignment of light sources of an illumination device it is known in the prior art to offset sections of a printed circuit board of the illumination device on which one or more of the light sources are fixedly mounted at an angle with respect to the remaining level printed circuit board. This enables the main radiation directions or optical axes of the light sources of different sections to be orientated differently. It is disadvantageous that producing an angular offset entails an increased investment in terms of resources and consequently also cannot usefully be accomplished locally on site. Furthermore, the number and type of light sources cannot be variably adjusted. Conductor tracks in the vicinity of the bending edge may also tear if the bend is extreme.

An illumination device having a plurality of rigid printed circuit boards is also known in which the printed circuit boards are in each case populated with at least one light source and are connected in series with one another by means of flexible sections. It is disadvantageous that the bend can only be produced in the longitudinal direction of the illumination device and in order to set a desired angle between two printed circuit boards it is necessary in addition to fix these in position by means of a securing device. Furthermore, the number of printed circuit boards and number and type of light sources per printed circuit board are not variably adjustable on site.

Also known are LED tapes having a ribbon-like flexible printed circuit board, with a series of light-emitting diodes being mounted on the printed circuit board. It is disadvantageous that the flexibility is given essentially only in the longitudinal direction of the illumination device and in addition setting a desired angle between the light-emitting diodes requires the bend to be precisely positioned and the flexible printed circuit board to be fixed in place accordingly. Although the number of light sources is variably adjustable locally by customizing the printed circuit board on site, the type of light sources is not.

SUMMARY OF THE INVENTION

One object of the present invention is to mitigate at least to some degree or even to eliminate at least one of the cited disadvantages and in particular to provide a possible means of simple and variable adjustment of light emittance also locally at the installation site.

This and other objects are attained in accordance with one aspect of the present invention directed to a base carrier for an illumination device, said base carrier comprising a printed circuit board having at least one (first) plug-in connection element for mechanically securing and electrically coupling a light source carrier to the base carrier or its printed circuit board.

The printed circuit board of the base carrier has in particular at least one printed circuit board substrate and a single-layer or multilayer wiring scheme. The printed circuit board can optionally also be populated with at least one electronic component. The plug-in connection element is not restricted to a specific type and can be embodied as a male part of a plug-in connection or as a female part of a plug-in connection.

Said base carrier has the advantage that different light source carriers can be secured on the base carrier by way of the same plug-in connection element by means of a simple attachment operation. Thus, the base carrier or the printed circuit board can be variably configured based on the choice of the at least one light source carrier and adapted to the desired lighting situation, and furthermore this can also be done locally on site (e.g. when being installed in a lighting fixture) by a technician without a special tool. The matching light source carriers can differ from one another for example in respect of the type of light source, their number, configuration (e.g. with or without optics), alignment, etc.

It is an embodiment that the printed circuit board of the base carrier has at least one (second) plug-in connection element for mechanically securing and electrically coupling a ballast module to the printed circuit board. The printed circuit board of the base carrier provides a wiring scheme or an electrical connection between the second plug-in connection element and the at least one first plug-in connection element.

The ballast module has at least one ballast function and a plug-in connection mating element matching the second plug-in connection element. Accordingly, not only the light source carriers or light sources can be easily varied, but also their means of actuation. The ballast module can also be connected in a simple manner to the base carrier. This can be useful e.g. in the case of types of light source carriers or light sources of different potential (single-color LEDs, multicolor LEDs, halogen spotlights, etc.). The ballast module preferably possesses a function of an electronic ballast (EB) or is such.

The second plug-in connection element can in particular conduct two or more different voltages, e.g. 230 V (or a different line voltage) and 24 V (or a different low voltage).

In order to avoid mistakes in keying or plug-in position, the first plug-in connection element and the second plug-in connection element are embodied differently, in particular to prevent mis-mating.

The second plug-in connection element can be in particular a male connector, in particular having one or more contact pins.

It is also an embodiment that the printed circuit board of the base carrier is offset at an angle in a section carrying the first plug-in connection element. This enables an inclination of the light source carrier or its printed circuit board in respect of the base carrier or its printed circuit board to be set particularly easily. At the same time the bending angle can be kept small in particular in the case of a substantially lateral emittance, thereby avoiding the risk of a conductor track break on the base carrier.

It is yet another embodiment that the first plug-in connection element is offset at an angle relative to the printed circuit board of the base carrier. In this way an angle of inclination of the light source carrier relative to the printed circuit board of the base carrier can be realized without bending the base carrier or the light source carrier.

It is furthermore an embodiment that the first plug-in connection element is a socket. The socket provides a mechanically stable base for the light source carrier. Furthermore, mis-mating can be particularly easily prevented in this way if the second plug-in connection element is a male connector.

To assure ease of assembly, the first plug-in connection element is preferably a surface-mountable element (SMD element), in particular a reflow-capable SMD element.

It is also an embodiment that the printed circuit board of the base carrier is or includes a metal-core printed circuit board. This enables the printed circuit board to be used for dissipating waste heat of the light sources or other heat sources (e.g. a driver). However, the invention is not restricted thereto; thus, the printed circuit board can also include e.g. FR4 as a base material.

At least one heatsink can also be mounted on the printed circuit board to provide improved heat dissipation.

The printed circuit board of the base carrier can additionally have at least one securing means, e.g. a screw hole, for securing a positioning element for positioning the printed circuit board, e.g. a rod.

The printed circuit board of the base carrier can also have an electrical connection device for transmitting electrical power and control signals. For this it can be operatively connected to a supply line by means of a further (third) plug-in connection element. A simple electrical connection of the printed circuit board to the supply voltage, inside a lighting fixture for example, is thus possible.

The plug-in connection elements (of the first, second and third type) can each have at least one terminal for a supply voltage and at least one terminal for at least one signal line. In particular the plug-in connection elements can have at least two terminals, in particular precisely two terminals, for a supply voltage as well as at least two terminals, in particular precisely two terminals, for a signal line. Dedicated feed and return lines are in most cases necessary and useful for signal and supply lines, since defined current and signal paths are created therewith. It is of advantage in this case if a plug-in connection element of a plug-in connection has a male part having preferably four contact pins and a further plug-in connection element of the plug-in connection corresponding thereto has a female part having the sockets corresponding to the male part.

It is a development that the printed circuit board of the base carrier is embodied as substantially axially symmetrical, in particular rotationally symmetrical. This makes it suitable in particular for uniform, in particular all-round, in particular lateral light emission. The first plug-in connection elements can be arranged in particular in a border region of the printed circuit board, thereby minimizing a shadowing of the light cone generated by the light sources. Bending or offsetting the printed circuit board at an angle is also particularly easily possible in this way.

The printed circuit board of the base carrier is not, however, restricted to the axially symmetrical embodiment and alternatively can be embodied e.g. as rectilinear, e.g. with first plug-in connection elements arranged in series. Such an embodiment can be particularly favorable e.g. for wall mounting. In this case the first plug-in connection elements can be positioned parallel to their arrangement direction or offset at an angle.

Another aspect of the invention is directed to a light source carrier comprising at least one printed circuit board having at least one light source mounted thereon and a plug-in connection mating element mounted thereon for establishing a plug-in connection with a first plug-in connection element of a printed circuit board, in particular as described above.

This enables different light source carriers to be secured to the printed circuit board by way of the same plug-in connection element by means of a simple attachment operation. The printed circuit board can be variably configured based on the choice of the light source carrier and adapted to the desired lighting situation, and furthermore this can also be done locally on site (e.g. when being installed in a lighting fixture) by a technician without a special tool. The light source carriers can differ from one another for example in respect of the type of light source, their number, configuration (e.g. with or without optics), shape, alignment, etc.

Preferably the at least one light source comprises at least one light-emitting diode. If a plurality of light-emitting diodes are present these can emit light in the same color or in different colors. A color can be monochromatic (e.g. red, green, blue, etc.) or multichromatic (e.g. white). The light emitted by the at least one light-emitting diode can also be an infrared light (IR-LED) or an ultraviolet light (UV-LED). A plurality of light-emitting diodes can generate a mixed light, e.g. a white mixed light. The at least one light-emitting diode can contain at least one wavelength-converting luminescent substance (conversion LED). The at least one light-emitting diode can be present in the form of at least one individually packaged light-emitting diode or in the form of at least one LED chip. A plurality of LED chips can be mounted on a common substrate ("submount"). The at least one light-emitting diode can be equipped with at least one dedicated and/or collective optical element for beam guidance, e.g. at least one Fresnel lens, collimator, and so forth. Instead of or in addition to inorganic light-emitting diodes, e.g. based on InGaN or AlInGaP, organic LEDs (OLEDs, e.g. polymer OLEDs) can also be used in general. Diode lasers, for example, or other solid-state light sources can also be used.

It is an embodiment that the printed circuit board of the light source carrier has at least two sections offset at an angle relative to one another, at least one light source being arranged in each of the sections in each case. In other words, the light source carrier can have two light sources arranged offset at an angle relative to each other. This enables a different alignment of the main emission direction of the light sources of the light source carrier to be achieved in a particularly simple manner.

It is a special embodiment that one section has the plug-in connection mating element. A horizontally lateral emission can easily be achieved in this way.

It is another embodiment that at least one optical element is assigned to or arranged downstream of at least one of the light sources. The optical element enables beam forming to be varied to an even greater extent. In particular an optical element which deflects or modifies a main emission direction or optical axis can be arranged downstream of each light source and/or light sources aligned in the same direction. Thus, in one variant, different emission directions can be produced even with a printed circuit board of the light source carrier that is not offset at an angle. An optical element that changes the emission direction can also be used in conjunction with angularly offset sections, e.g. in order to change the emission direction to a different direction from the angle included by the two sections or in order to achieve a stronger deflection.

It is a development that the plug-in connection mating element comprises a direct male connector. This enables a separate plug-in connection element to be dispensed with, thus saving costs and production resources. The direct male connector can in particular include a projecting border region of the printed circuit board on which a wiring scheme of the printed circuit board provides at least one electrical contact surface (contact pad), in particular a series of electrical contact surfaces.

It is another development that the light source carrier includes a metal-core printed circuit board as the printed circuit board. The metal-core printed circuit board improves heat dissipation from the at least one light source. However, the printed circuit board is not limited to a metal-core printed circuit board.

At least one heatsink can be arranged on the printed circuit board of the light source carrier.

Another aspect of the invention is directed to a system including the base carrier, in particular as described above, and at least one light source carrier, in particular as described above, wherein the plug-in connection mating element of the light source carrier is inserted into a first plug-in connection element of the base carrier.

The system can also be embodied as an illumination device.

It is a development that the light source carriers are enclosed at least in sections by a common optical element, in particular a diffusor. Said diffusor can contain e.g. an opaque, in particular milkily translucent, material. The diffusor can be embodied e.g. as tubular in shape and e.g. be mounted onto the printed circuit board such that it laterally surrounds the light source carriers. This enables a homogenization of the light emitted by the system to be realized particularly easily.

It is another development that the system is provided for use in a streetlight. In this case the variable light emission can be used particularly advantageously, e.g. for creating a plurality of illumination zones (near-field lighting, far-field lighting) and/or for adapting to different environments (open environment, restricted environment), etc.

The system can accordingly achieve an alignment of the light sources in that a section of the base carrier which is populated with the first plug-in connection element is bent at an angle, that the first plug-in connection element is mounted offset at an angle on the base carrier, that at least two light sources of the light source carrier are offset at an angle relative to one another (e.g. by bending or curving the light source carrier) and/or that at least one optical element connected downstream of at least one light source changes the emission direction of the light source.

BRIEF DESCRIPTION OF THE DRAWINGS

The invention is described in greater detail below with reference to exemplary embodiments and the attached drawings. For clarity of illustration reasons, like or like-acting elements are labeled therein with the same reference signs.

DETAILED DESCRIPTION OF THE DRAWINGS

Figure 1:
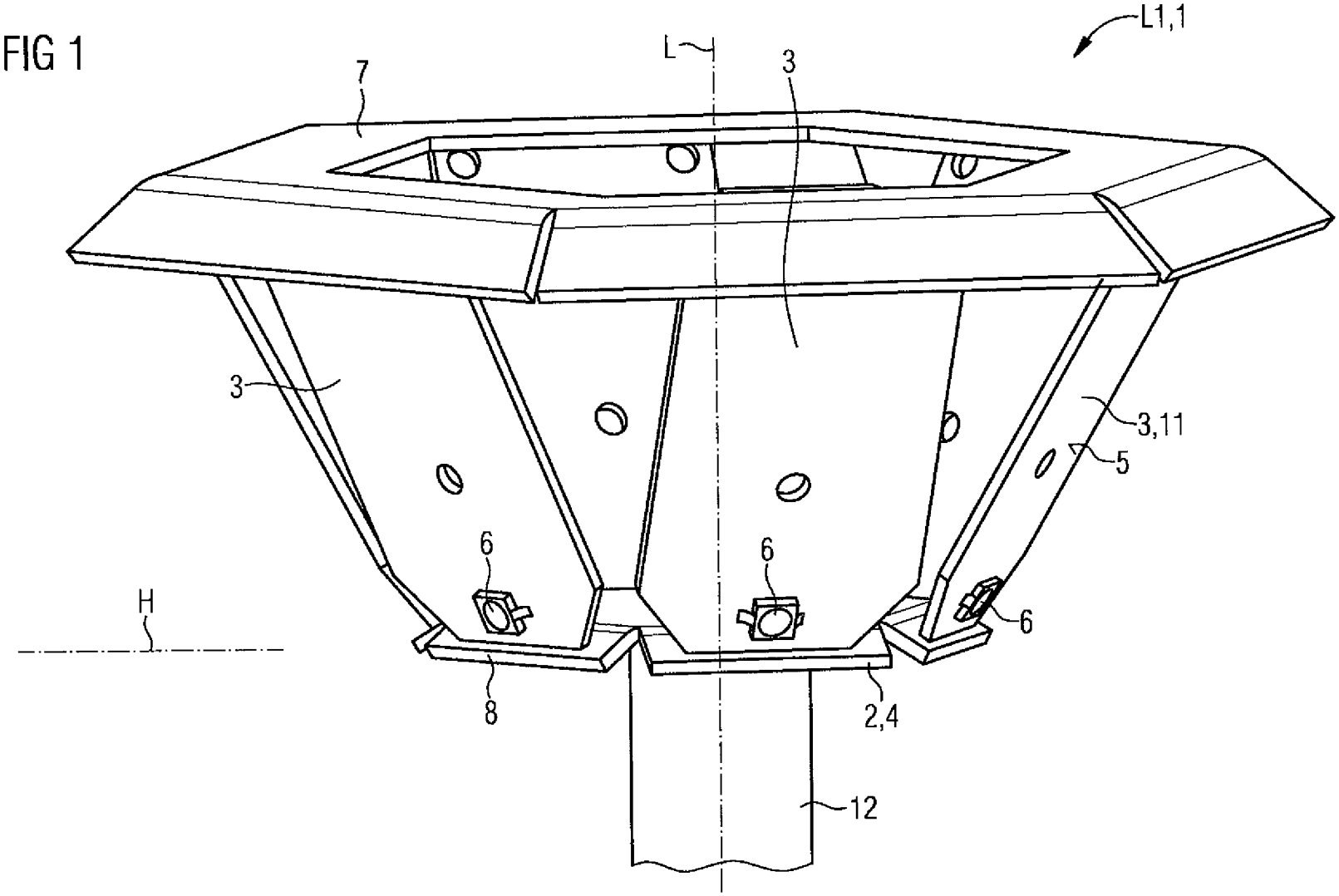
FIG. 1 shows an oblique view from above onto an illumination device having a system comprising a base carrier and a plurality of light source carriers according to a first exemplary embodiment.
Figure 2:
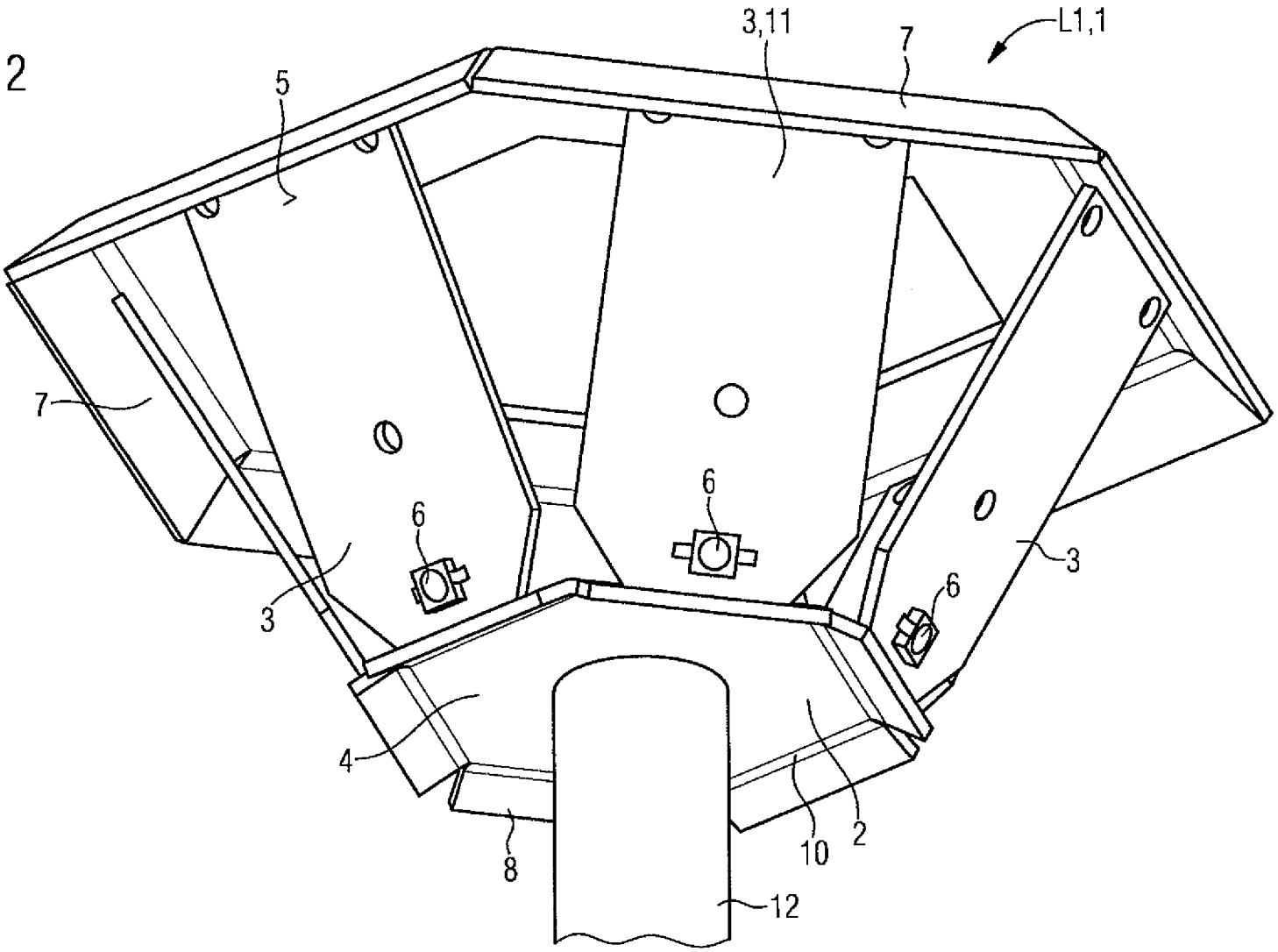
FIG. 2 shows the illumination device according to the first exemplary embodiment in an oblique view from below.

FIG. 1 and FIG. 2 both show an illumination device L1 comprising a system 1, wherein the system 1 has at least one base carrier 2 and a plurality (in this case: six) of light source carriers 3. Each of the light source carriers 3 is connected to the base carrier 2 by means of a plug-in connection. For that purpose the base carrier 2 has a printed circuit board 4 having in this case six plug-in connection elements 9 (shown in FIG. 3) for mechanically securing and electrically coupling the light source carriers 3 to the printed circuit board 4 or the base carrier 2.

The light source carrier 3 likewise has a printed circuit board 11 on which in the present arrangement a light-emitting diode 6 is mounted on a respective outside face 5. To ensure the mechanical stabilization of the light source carriers 3 the latter are mechanically connected to one another at their end opposite the base carrier 2 by means of a holding frame 7.

Figure 3:
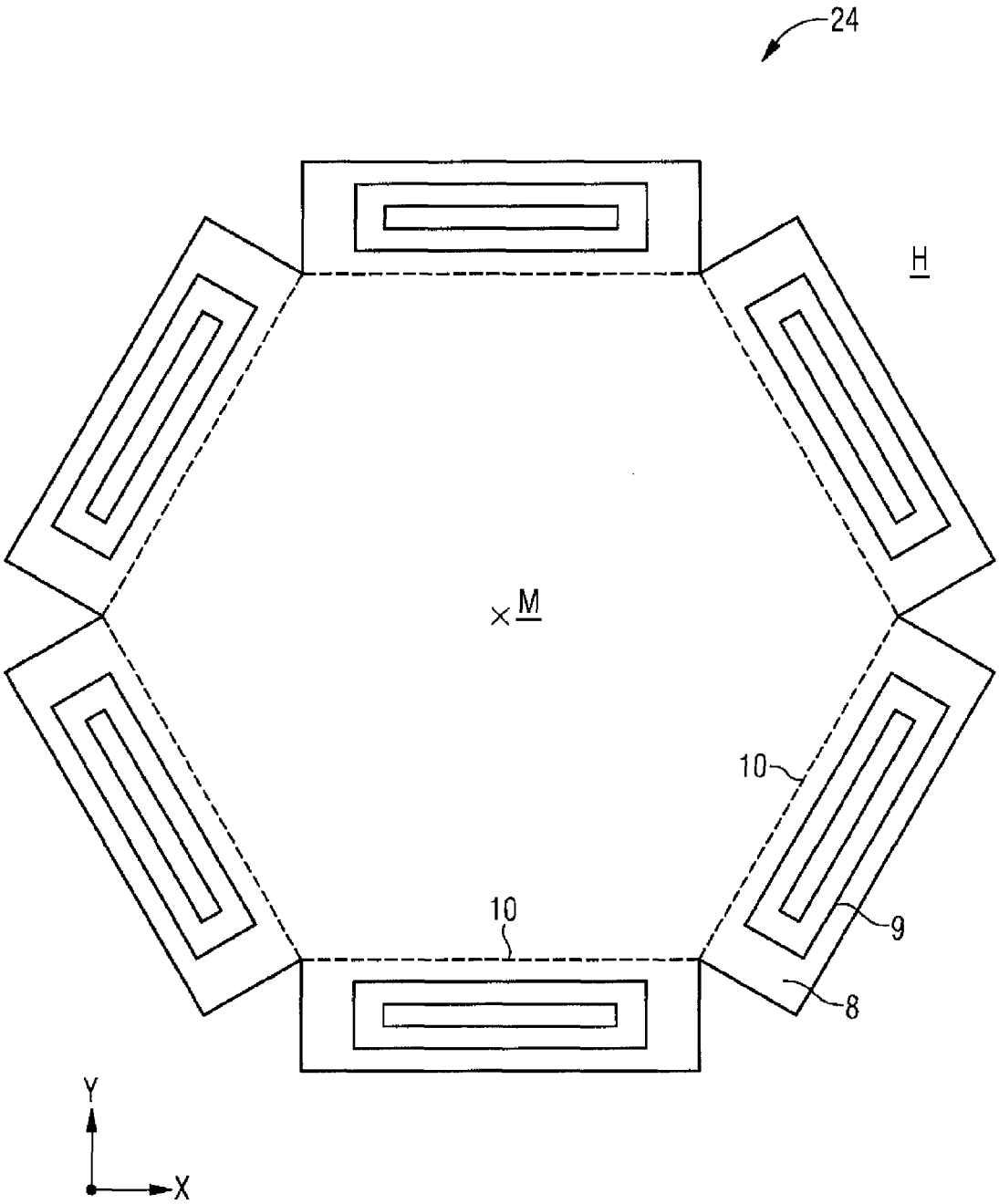
FIG. 3 shows a plan view onto a printed circuit board of the base carrier of the illumination device according to the first exemplary embodiment.

As also shown more precisely in FIG. 3 in a plan view (onto a horizontal plane), the printed circuit board 4 of the base carrier 2 is formed axially symmetrically around a center point M, namely with a sixfold symmetry. A longitudinal axis of the printed circuit board 4 also runs through the center point M vertically to the image plane.

Sections 8, each carrying a first plug-in connection element 9 in the form of a socket, project laterally at the border region of the printed circuit board 4. The sections 8 are embodied as plate-shaped and can be bent or offset at an angle with respect to the rest of the printed circuit board 4 along a respective bending line 10. This angularly offset position is shown in FIG. 1 and FIG. 2, where the projecting sections 8 are bent downward such that the light source carriers 3 do not extend upward at right angles to the printed circuit board 4, but at an angle to the vertical corresponding to the bending angle of the projecting sections 8. In the view illustrated, in which the principal plane of the base carrier 3 is located in the horizontal and the plug-in connection results in a vertical arrangement of the light source carriers 3 on the printed circuit board 4, the inclination of the light source carriers 3 can therefore be set by means of the bending angle of the projecting section 8. In this arrangement the light source carriers 3 themselves are flat and not bent.

Both the printed circuit board 4 of the base carrier 2 and the printed circuit board 11 of the light source carrier 3 are implemented as metal-core printed circuit boards in order to achieve good heat dissipation.

Each of the light-emitting diodes 6 has a primary optic 32 (see FIG. 6) in order to be able to more strongly concentrate the light emitted by the associated light-emitting diode chip.

A positioning element in the form of a rod 12 is fixed to the underside of the base carrier 2 in order to enable the system 1 to be positioned correctly on a lighting fixture. The system 1 shown or the illumination device L1 can be used for example as an illumination device L1 for a streetlight, wherein light emitted by the light-emitting diodes 6 can be radiated substantially laterally in all directions and at the same time is directed obliquely downward. For that purpose the illumination device L1 can be enclosed by one or more diffusor elements.

Figure 4:
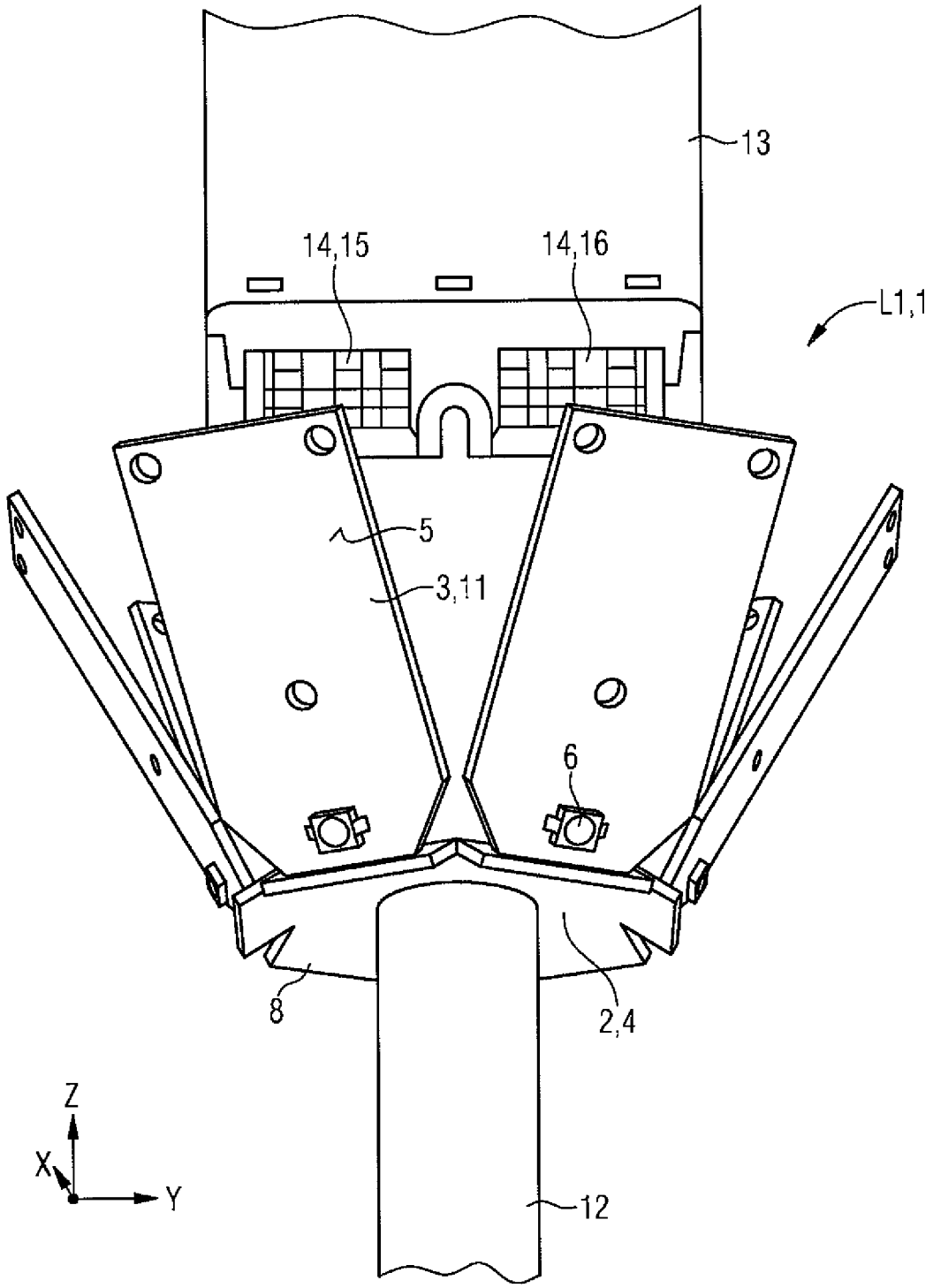
FIG. 4 shows an oblique view from below of the illumination device according to the first exemplary embodiment in an exploded representation with a ballast.

The illumination device L1 additionally has an electronic ballast module 13 which can be plug-mounted onto the base carrier 2 and is shown in more detail in FIG. 4. The illumination device L1 is shown without the holding frame 7 in FIG. 4. The EB (electronic ballast) module 13 has a female part 14 of a connection, namely a first part 15 for connecting an electrical line voltage, e.g. 230 V alternating voltage, and a part 16 for connecting a low voltage, e.g. 24 V direct voltage. Generally the plug-in connection can conduct different voltage levels. The EB module 13 can be plug-mounted onto the base carrier 2, which has one or more corresponding matching elements of the plug-in connection for that purpose, for example contact pins (not shown) in this case protruding vertically from the surface of the base carrier 2, which can engage with the plug-in connection 14.

The electrical attachment of the illumination device L1 or of the system 1 can be established by means of electrical connections (not shown) which can run e.g. through the rod 12 embodied as a hollow rod.

In general the holding frame 7 can also be dispensed with.

Figure 5:
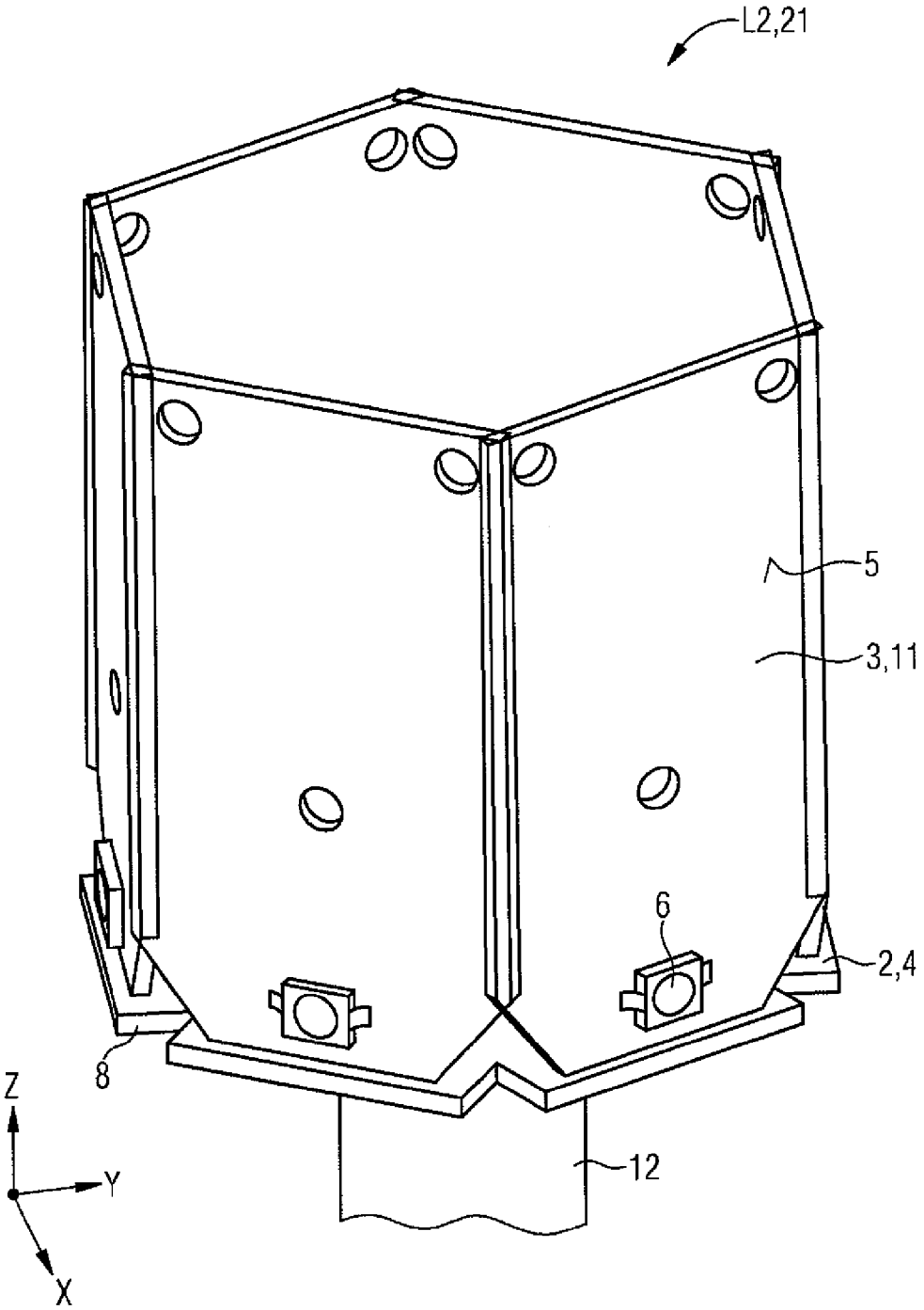
FIG. 5 shows an oblique view from above onto an illumination device having a system comprising a base carrier and a plurality of light source carriers according to a second exemplary embodiment.

FIG. 5 shows an illumination device L2 having a system 21 similar to the system 1 of the first exemplary embodiment, and moreover without the holding frame 7, with neither the base carrier 2 nor the light source carrier 3 now being bent at an angle. Instead, the printed circuit boards 11 and 4 stand at right angles to one another. The light-emitting diodes 6 are accordingly aligned laterally or horizontally. An emission direction of the light-emitting diodes 6 can nonetheless deviate thereby from the vertical direction, e.g. can be redirected in a main emission direction obliquely downward, in that the associated primary optic 32 of the light-emitting diodes 6 produces a corresponding beam deflection. The system 21 shown in FIG. 5 is particularly compact. In order to homogenize the light radiated laterally by the light-emitting diodes 6, a milky white, opaque tube, for example, can also be slipped over the light source carrier 3.

An EB module inside the light source carrier 3 can be plug-mounted onto the base carrier 2 in the system 21 also. This results in a particularly flexible configuration option. Alternatively or in addition, however, driver devices can also be fixedly mounted on the base carrier 2 or its printed circuit board 4. The printed circuit board 4 is then a populated printed circuit board.

Figure 6:
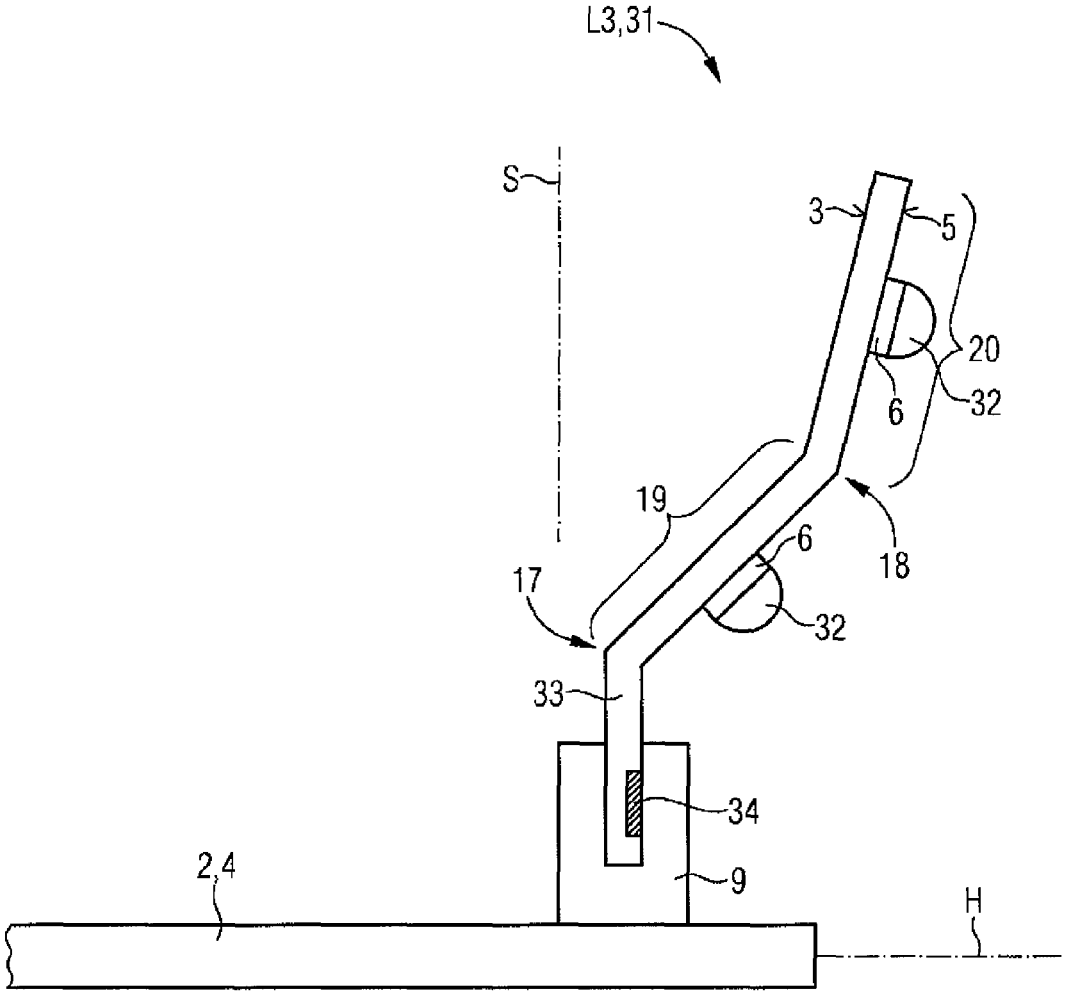
FIG. 6 shows as a sectional representation in a side view a detail from a system comprising a base carrier and a plurality of light source carriers according to a third exemplary embodiment.

FIG. 6 shows as a detail in a side view an illumination device L3 having a system 31 in which the base carrier 2 and its printed circuit board 4 are now embodied as flat (with their propagation plane in the horizontal H), and the first, female plug-in connection element is mounted directly (not offset at an angle) on the printed circuit board 4. The printed circuit board 4 can be embodied for example as shown in FIG. 3. In contrast to the first exemplary embodiment and the second exemplary embodiment, the light source carriers 3 are now bent, in this case twice along corresponding bending lines 17, 18. By this means two sections 19 and 20 offset at an angle to each other are formed on the light source carrier 3, each of the sections carrying one or more light-emitting diodes 6 on their outside face 5. On account of the bend at the bending line 17, the two sections 19, 20 are also jointly offset at an angle to the vertical S. In this case the section 19 is offset at a greater angle to the vertical than the section 20. This results for example in the possibility of realizing a near-field illumination directed more strongly downward at the first section 19 and at the same time to realize a far-field illumination directed closer to the horizontal H by means of the section 20. In this case the light-emitting diodes 6 of the two sections 19, 20 can have the same primary optic 32 or different primary optics 32. For example, there can be differences in the extent of the beam widening or beam narrowing and/or a deflection of the main emission direction.

The section inserted in the first plug-in connection element 9 of the base carrier 2 is embodied as a plug-in connection mating element in the form of a direct male connector 33 having corresponding contact fields 34 and crossing over into the first section 19 across the bending line 17.

It is self-evident that the present invention is not limited to the illustrated exemplary embodiments.

Accordingly, features of the different exemplary embodiments can also be combined with one another, e.g. the bending of the base carrier 2 with a bending of the light source carrier 3.

The invention claimed is:

1. A base carrier for an illumination device, comprising:

a printed circuit board;

at least one first plug-in connection element arranged on the printed circuit board and configured to mechanically secure and operationally electrically couple a light-emitting diode (LED) light source carrier to the printed circuit board; and at least one second plug-in connection element arranged on the printed circuit board configured to mechanically secure and electrically couple a module to the printed circuit board, wherein the at least one first plug-in connection element is differently shaped than the at least one second plug-in connection.

2. The base carrier as claimed in claim 1, wherein the module is a ballast module.

3. The base carrier as claimed in claim 2, wherein the second plug-in connection element is a male connector.

4. The base carrier as claimed in claim 1, wherein the printed circuit board is offset at an angle in a section carrying the first plug-in connection element.

5. The base carrier as claimed in claim 1, wherein the first plug-in connection element is offset at an angle relative to the printed circuit board.

6. The base carrier as claimed in claim 1, wherein the first plug-in connection element is a socket.

7. The base carrier as claimed in claim 1, wherein the printed circuit board comprises a metal-core printed circuit board.

8. A light source carrier comprising at least one printed circuit board having at least one LED light source mounted thereon, and a plug-in connection mating element mounted thereon for establishing a plug-in connection with a first plug-in connection element of the base carrier as claimed in claim 1.

9. The light source carrier as claimed in claim 8, wherein its printed circuit board has at least two sections offset at an angle relative to each other, at least one light source being arranged in each of the sections in each case.

10. The light source carrier as claimed in claim 8, wherein at least one optic is assigned to at least one of the light sources.

11. The light source carrier as claimed in claim 8, wherein the plug-in connection mating element comprises a direct male connector.

12. The light source carrier as claimed in claim 8, wherein the printed circuit board comprises a metal-core printed circuit board.

13. A system comprising:

the base carrier as claimed in claim 1; and at least one LED light source carrier comprising at least one printed circuit board having at least one LED light source mounted thereon, and a plug-in connection mating element mounted thereon for establishing a plug-in connection with a first plug-in connection element of the base carrier;

wherein the plug-in connection mating element of the LED light source carrier is inserted into said first plug-in connection element of the base carrier.

14. The system as claimed in claim 13, wherein the light source carriers are enclosed at least in sections by a common optical element.

15. The system as claimed in claim 13, wherein the system is provided for use in a streetlight.

16. The system as claimed in claim 14, wherein said common optical element is a diffusor.

* * * * *